US006782811B2

(12) United States Patent
Brendel

(10) Patent No.: US 6,782,811 B2
(45) Date of Patent: Aug. 31, 2004

(54) EXTENDED-NIP ROLL PRESS FOR DEWATERING A FIBROUS WEB

(75) Inventor: Bernhard Brendel, Grefrath (DE)

(73) Assignee: Eduard Küsters Maschinefabrik GmbH & Co. KG, Krefeld (DE)

( * ) Notice: Subject to any disclaimer, the term of this patent is extended or adjusted under 35 U.S.C. 154(b) by 0 days.

(21) Appl. No.: 10/236,056

(22) Filed: Sep. 4, 2002

(65) Prior Publication Data

US 2003/0061946 A1 Apr. 3, 2003

(30) Foreign Application Priority Data

Sep. 7, 2001 (DE) ..... 201 14 857 U

(51) Int. Cl.[7] ..... B30B 3/02

(52) U.S. Cl. ..... 100/162 R; 100/168; 100/172; 100/176

(58) Field of Search ..... 100/327, 155 R, 100/156, 162 R, 168, 172, 176; 162/205, 358.3, 358.4, 361, 358.1, 202, 203; 492/16, 20

(56) References Cited

U.S. PATENT DOCUMENTS 4,570,314 A * 2/1986 Holik et al. ..... 492/4
4,944,089 A * 7/1990 Flamig et al. ..... 29/895.22
5,753,083 A * 5/1998 Schiel et al. ..... 162/358.3
6,010,443 A * 1/2000 Dahlbom et al. ..... 492/20
6,126,789 A * 10/2000 Schiel et al. ..... 162/358.3

FOREIGN PATENT DOCUMENTS

DE 29702362 U1 5/1997

* cited by examiner

*Primary Examiner*—Allen Ostrager
*Assistant Examiner*—Shelley Self
(74) *Attorney, Agent, or Firm*—Townsend and Townsend and Crew LLP

(57) ABSTRACT

Extended-nip roll press for dewatering a material web comprises a rotating mating roll and an extended-nip press roll. The extended-nip press roll has a stationary support and a flexible roll cover which rotates about the support. A press shoe is arranged on the support, and the roll cover has end sections which are clamped firmly on rotatable end walls on the support. End wall clamping rings respond to a first actuating device and clamp a resilient spreader ring radially against an outer ring that can be connected firmly to the end walls. A sealing ring is arranged on each end wall adjacent the clamping ring and can be deformed radially against the outer ring by means of a second actuating device.

10 Claims, 4 Drawing Sheets

EXTENDED-NIP ROLL PRESS FOR DEWATERING A FIBROUS WEB

CROSS-REFERENCES TO RELATED APPLICATIONS

This application claims priority from German application no. 201 14 857.9 filed on Sep. 7, 2001, under 35 USC §119, the full disclosure of which is incorporated herein by reference.

BACKGROUND OF THE INVENTION

The invention relates to an extended-nip roll press for dewatering a fibrous web.

BRIEF SUMMARY OF THE INVENTION

An extended-nip roll press of this type is disclosed, for example, by DE 297 02 362 U1. According to that document, a clamping ring is provided to clamp the respective end section of the roll cover firmly, and is axially displaceably mounted on a part of the end wall which is cylindrical in some sections. The end wall is also assigned an outer ring, so that, in the circumferential area of the end wall, an annular groove that is open towards the opposite, other end wall is formed, which is bounded radially on the inside by the cylindrical part of the end wall, extending axially into the interior of the roll, and radially on the outside by an inner circumferential surface of the outer ring. The clamping ring comprises a wedge section having a conical outer circumferential surface with which the said ring engages in the annular groove. In addition, a resilient spreader ring is inserted into the annular groove, its inner circumferential surface forming a conical opposing surface that interacts with the conical outer circumferential surface of the clamping ring. On the other hand, the outer circumferential surface of the spreader ring is cylindrical and is provided with grooves in order to increase adhesion. Resilient sealing material, for example, can be inserted into these grooves. In a clamping position of the clamping ring, in which the spreader ring is widened radially because of active engagement of the wedge surfaces, the end section of the roll cover is clamped firmly in a sealing manner in a clamping gap which is formed by the cylindrical outer circumferential surface of the spreader ring and the cylindrical inner circumferential surface of the outer ring. As a result, the roll cover is pressed against the cylindrical inner surface of the outer ring.

However, it has proven to be disadvantageous that the sealing effect in the clamping position is not sufficiently good.

SUMMARY AND OBJECTS OF THE INVENTION

It is therefore an object of the invention to provide an extended-nip roll press in which attachment of the respective end section of the roll cover ensures reliable sealing. This objective is achieved by an extended-nip roll press in which the clamping engagement and the sealing engagement are functionally separated. By means of separately acting actuating devices, the clamping ring and the sealing ring are tightened separately. Individual adjustment and/or readjustment of the clamping ring and of the sealing ring are in each case possible as required. Further advantages and refinements of the invention may be gathered from the following description and the subclaims.

DETAILED DESCRIPTION OF THE INVENTION

Figure 1:
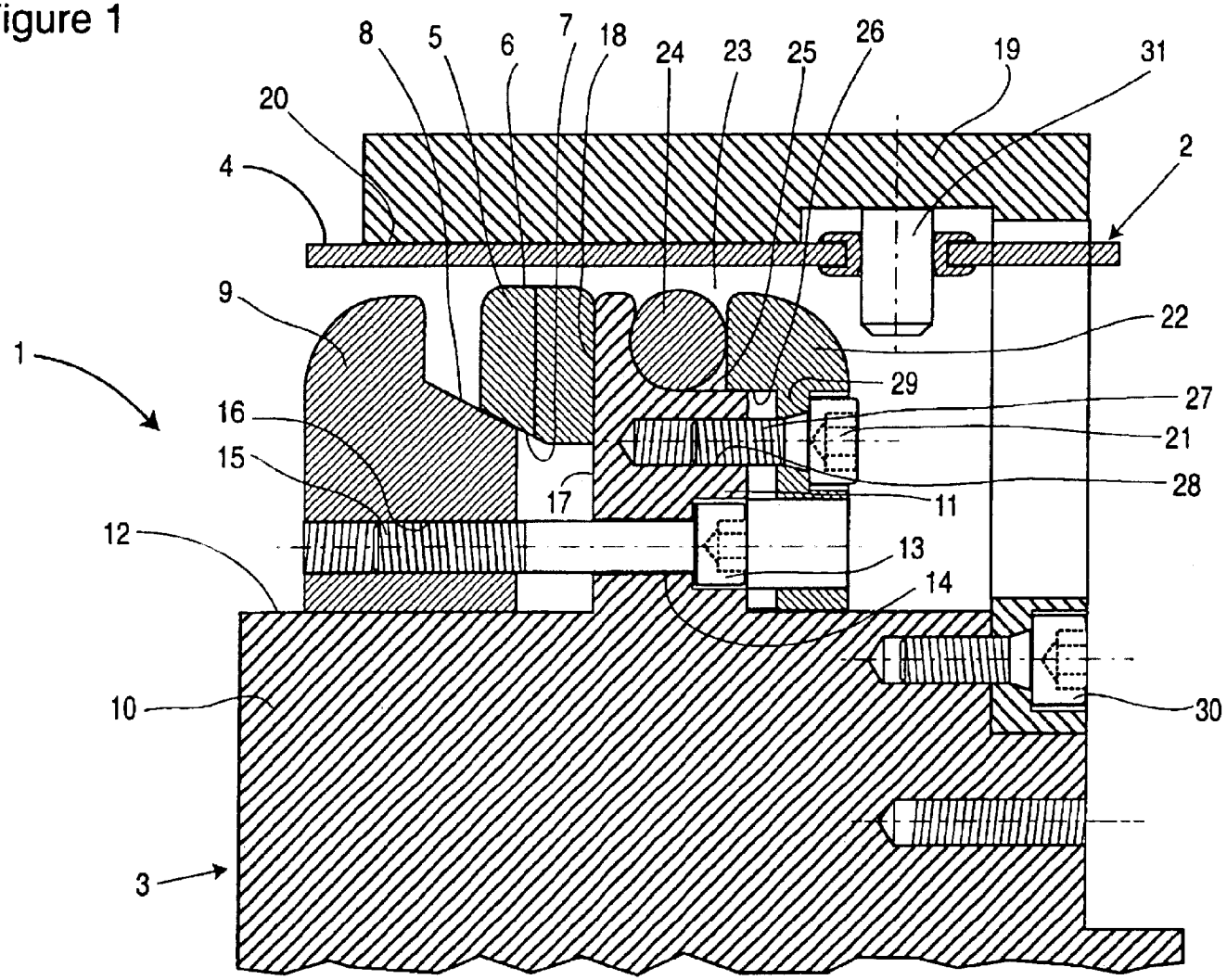
FIG. 1 shows schematically a partial section through one end of an extended-nip press roll with clamping ring and sealing ring in the disengaged position.

FIG. 1 shows the upper half of the right-hand part of an extended-nip press roll 1 which, with a rotating mating roll, not illustrated, forms a press nip for dewatering a material web in an extended-nip roll press.

The extended-nip press roll 1 comprises a stationary support, not illustrated, and a roll cover 2 which can be rotated around the support and which consists of a flexible material, for example rubber or plastic. The roll cover 2 is formed like a hose and, in the region between the two roll ends and forming the press nip with the mating roll, is supported by at least one supporting element, the press shoe, as it is called, which is not illustrated. Between the roll cover inner side and the press shoe, a film of lubricant is produced in a hydrodynamic or hydrostatic way.

Supported on the support are two end walls 3, of which only the right-hand one is shown. The two end sections 4 of the roll cover 2 are fixed in an air-tight and oil-tight manner to these end walls 3. For this purpose, the end sections 4 are clamped firmly to the associated end wall 3, as will be explained below with reference to FIGS. 1 to 3.

In order to clamp the respective end section 4 of the roll cover 2 firmly, a spreader ring 5 is provided. This spreader ring 5 has a cylindrical outer circumferential surface 6 and an inner circumferential surface 7 which is conical, at least in some sections. This conical inner circumferential surface 7 of the spreader ring 5, together with a conical outer circumferential surface 8 of a clamping ring 9, forms interacting conical opposing surfaces. The clamping ring 9 is axially displaceably mounted on a part 10 of the end wall 3 which is cylindrical, at least in some sections. This partially cylindrical part 10 extends axially into the interior of the roll, starting from a flange 11 belonging to the end wall 3. Towards the interior of the roll, the flange 11, together with the cylindrical part 10 of the end wall 3, bounds an annular groove 12, into which the clamping ring 9 and the spreader ring 6 are inserted.

In order to move the clamping ring 9 axially, an actuating device 13 is provided, which is formed here as a bolt or screw and extends with a shank section from the end of the roll through an axial through hole 14 in the flange 11. For this purpose, the through hole 14 has a stop for the bolt or screw head. The actuating device 13 engages with a threaded section 15 in an axial threaded hole 16 in the clamping ring 9. By means of the actuating device 13, that is to say rotation of the screw or of the bolt, the clamping ring 9 can be moved with respect to the flange 11, that is to say can be moved towards the latter to clamp the end sections 4 of the roll cover 2 firmly or moved away from it to loosen the clamping action.

The spreader ring 5, which is inserted into the annular groove 12 together with the clamping ring 9, has a radially extending end face 18, with which the spreader ring 5 is supported on a top side 17 of the flange 11 such that it can be displaced by sliding.

The end wall 3 is also assigned an outer ring 19, which can be connected detachably to the end wall 3 by means of screws 30.

Figure 2:
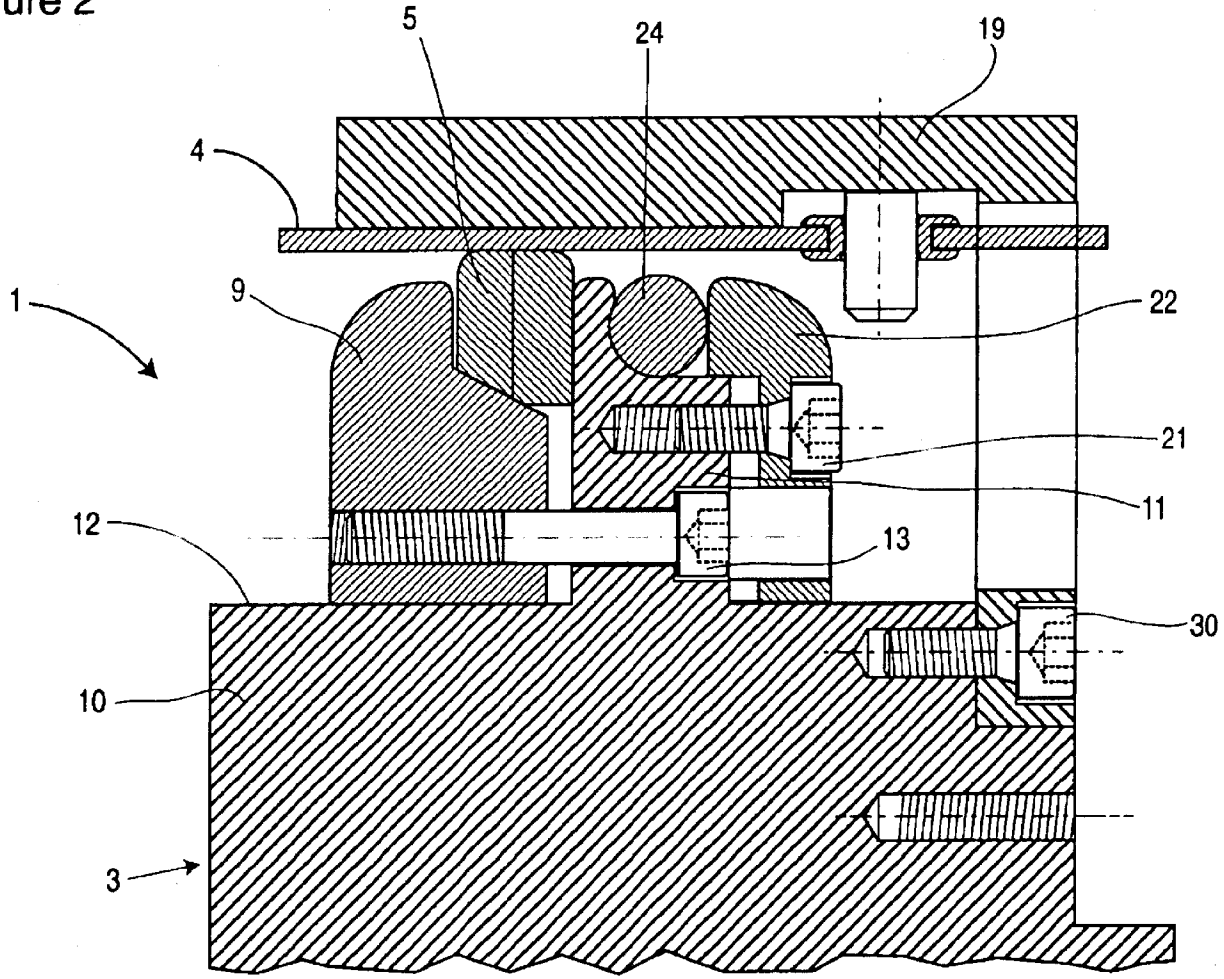
FIG. 2 shows schematically a partial section through one end of an extended-nip press roll with clamping ring in the engaged position and sealing ring in the disengaged position.

The clamping ring 9 has a wedge section which tapers axially outwards and which forms the conical outer circumferential surface 8 which interacts with the conical inner circumferential surface 7 of the spreader ring. Accordingly, if the clamping ring 9 is pulled against the flange 11 by means of the actuating device 13, the spreader ring 5 widens in the radial direction, guided by the surfaces 8 and 18, and is moved into a clamping position as illustrated in FIG. 2. In the clamping position illustrated in FIG. 2, the end section 4 of the roll cover 2 is clamped firmly in a clamping gap which is formed by the cylindrical outer circumferential surface 6 of the spreader ring 5 and the cylindrical inner circumferential surface 20 of the outer ring 19.

Figure 3:
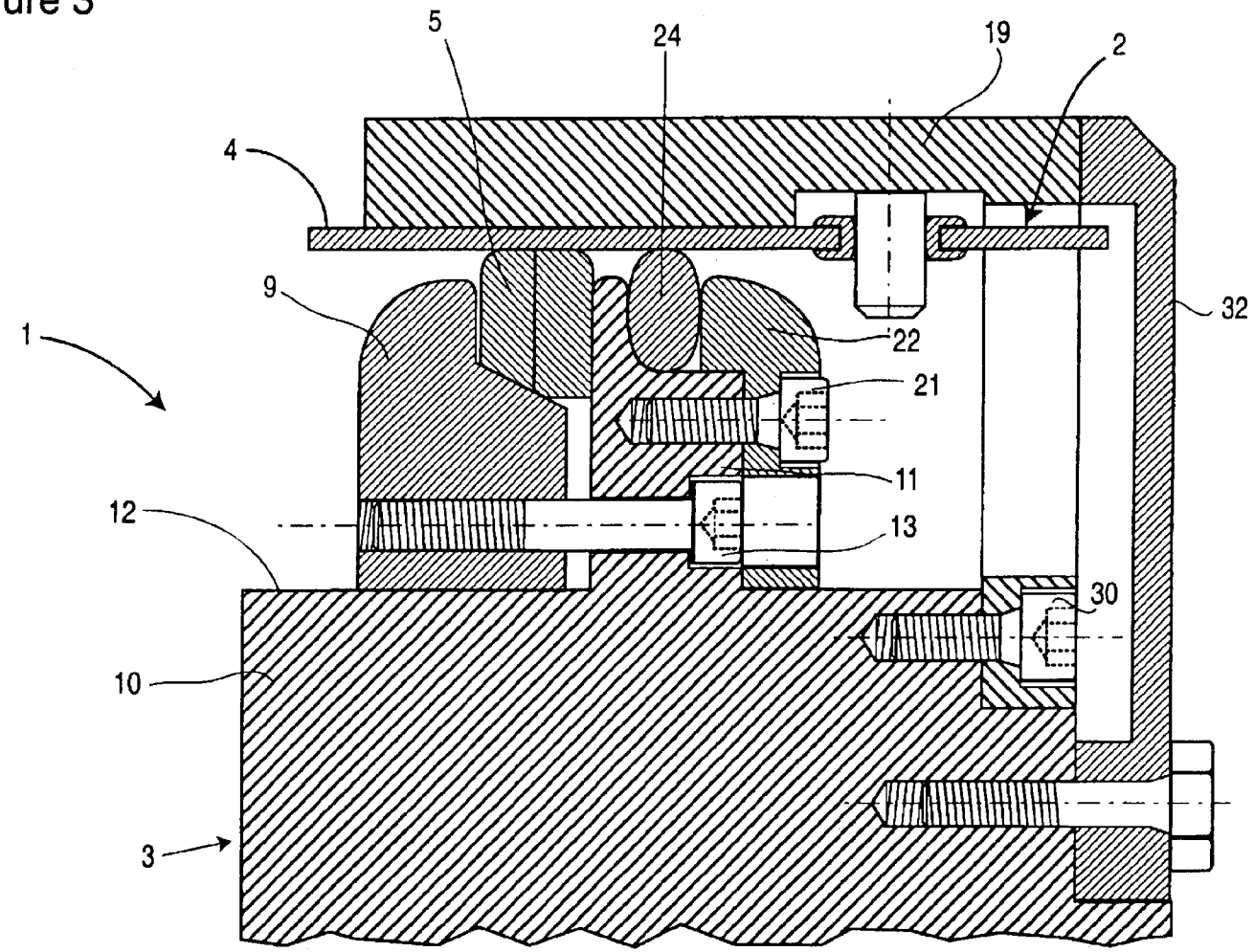
FIG. 3 shows schematically a partial section through one end of an extended-nip press roll with clamping ring and sealing ring in the engaged position.

Sealing the clamping gap is separated physically from this firm clamping of the respective end section 4. As FIG. 1 shows, the outer circumferential surface of the flange 11 forms an annular groove 23 with a clamping piece 22 in order to accommodate a sealing ring 24, which preferably consists entirely of an elastomer, for example rubber. In the unloaded state, the sealing ring 24 preferably has a round cross section. The clamping piece 22 is guided on the flange 11 such that it can be moved axially, for which purpose the latter has a portion 25 which is cylindrical, at least in some sections, on the side facing away from the interior of the roll, and on which a cylindrical opposing surface 26 of the clamping piece 22 can be moved axially, in order to be able to reduce the axial dimension of the annular groove 24. By this means, the sealing ring 24 is compressed, as a result of which it is deformed elastically and lengthens radially, as illustrated in FIG. 3. The sealing ring 24 is clamped in by the clamping piece 22 in such a way that the latter clamps the end section 4 of the roll cover 2 in a sealing manner against the inner circumferential surface 20 of the outer ring 19.

The clamping piece 22 can be moved against an end of the flange 11 facing the roll end by means of a second actuating device 21, which operates separately from the first actuating device 13. Here, the second actuating device 21 is formed as a bolt or screw, corresponding to the first actuating device 13, which engages with its threaded shank 27 in an axial threaded hole 28 in the flange 11. The clamping piece 22 has a through hole 29 with a stop to accommodate the second actuating device 21.

FIG. 3 shows the parallel clamping and sealing actions.

As an additional safeguard for the roll cover 2, retaining pins 31 can be inserted into the latter at the edge. Furthermore, a protective cover 32 can be fixed at the edge.

Figure 4:
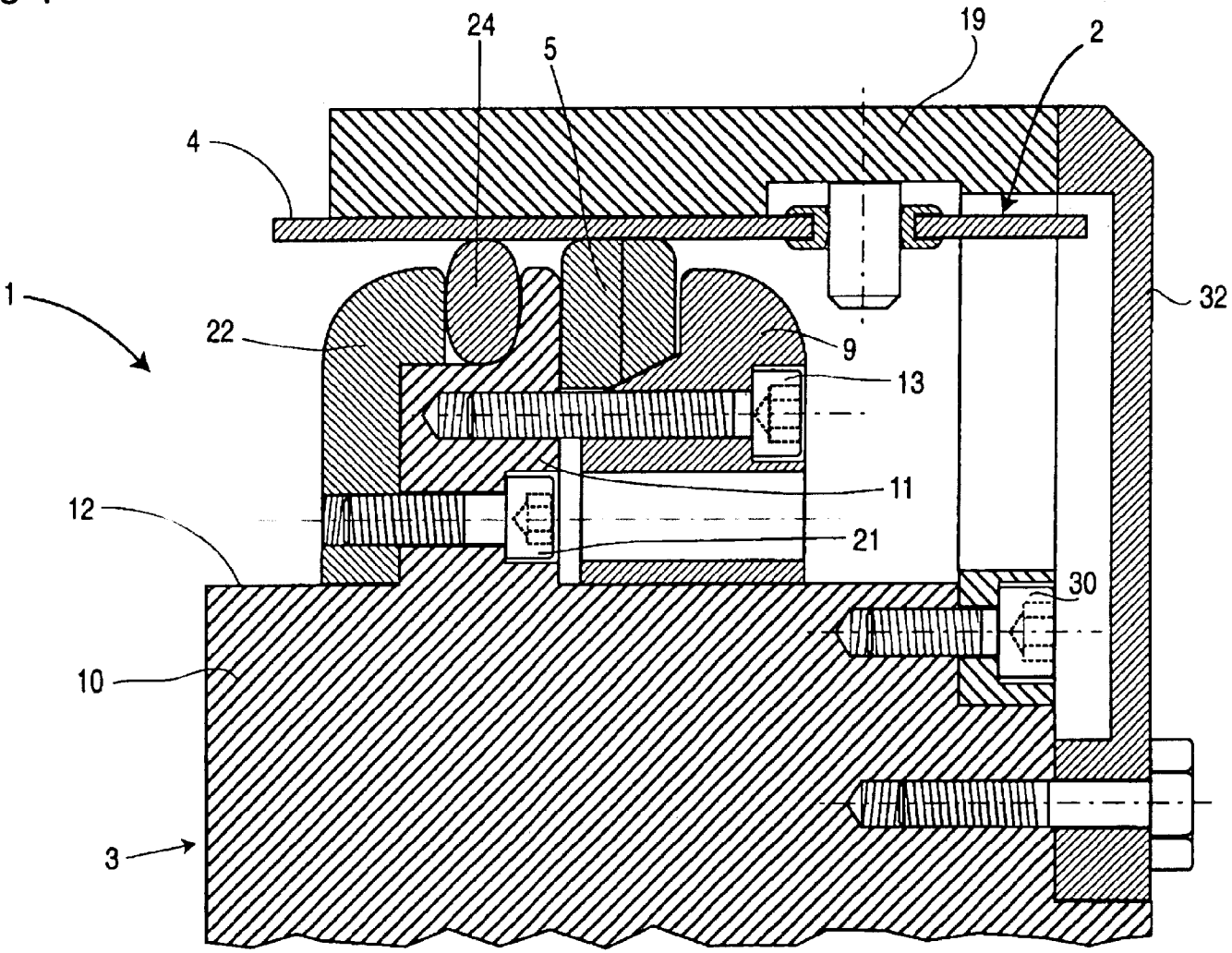
FIG. 4 shows schematically a partial section of a second exemplary embodiment.

As an alternative to the exemplary embodiment above, the sealing ring can be arranged on the side of the flange facing the interior of the roll, while the clamping ring with spreader ring is then arranged on the side of the flange facing the end of the roll, as illustrated in FIG. 4.

All publications and patent applications mentioned in this specification are herein incorporated by reference to the same extent as if each individual publication or patent application was specifically and individually indicated to be incorporated by reference.

The invention now being fully described, it will be apparent to one of ordinary skill in the art that many changes and modifications can be made thereto without departing from the spirit or scope of the appended claims.

What is claimed is:

1. An extended-nip press roll for an extended-nip roll press for dewatering a material web in a press nip comprising a rotating mating roll on one side and an extended-nip press roll on the other side, wherein the extended-nip press roll includes:

(a) a tubular flexible roll cover which rotates about its center, the roll cover having end sections at each end of the roll cover which are clamped firmly in a sealing manner on end walls, each end wall located on opposing sides of the roll cover and coupled to the end sections of the roll cover to close out an interior region of the roll cover;

(b) clamping rings which are axially displaceably guided on each end wall, wherein each clamping ring responds to a first actuating device and clamps a spreader ring with a cylindrical outer surface radially against an outer ring connected firmly to the end wall to clamp in each end section of the roll cover; and (c) a sealing rings arranged on each end wall adjacent to the clamping ring, said sealing ring being deformable radially against the outer ring by means of a second actuating device that acts separately from the actuation of the clamping ring in order to press an axial portion of the respective end section of the roll cover against the outer ring, wherein the sealing ring may be deformed radially by means of a clamping piece that can be moved by the second actuating device.

2. Extended-nip press roll according to claim 1, wherein the clamping ring has a conical outer circumferential surface which moves against an inner circumferential surface of the spreader ring, the said surface forming a conical opposing surface.

3. Extended-nip press roll according to claim 2, wherein the clamping ring has a cylindrical inner circumferential surface and the spreader ring has a cylindrical outer circumferential surface.

4. Extended-nip press roll according to any of claims 1, 2, or 3, wherein the sealing ring consists of an elastomer.

5. Extended-nip press roll according to any of claims 1, 2, or 3, wherein in the unloaded state, the sealing ring has a round cross section.

6. Extended-nip press roll according to any of claims 1, 2, or 3, wherein the sealing ring is arranged adjacent to the clamping ring, in each case towards the interior of the roll.

7. Extended-nip press roll according to any of claims 1, 2, or 3, wherein the sealing ring is arranged adjacent to the clamping ring, in each case towards the end of the roll.

8. An extended-nip press roll for an extended-nip roll press for dewatering a material web in a press nip comprising a rotating mating roll on one side and an extended-nip press roll on the other side, wherein the extended-nip press roll includes:

(a) a tubular flexible roll cover which rotates about its center, the roll cover having end sections at each end of the roll cover which are clamped firmly in a sealing manner on end walls, each end wall located on opposing sides of the roll cover and coupled to the end sections of the roll cover to close out an interior region of the roll cover;

(b) clamping rings which are axially displaceably guided on each end wall, wherein each clamping ring responds to a first actuating device and clamps a spreader ring with a cylindrical outer surface radially against an outer ring connected firmly to the end wall to clamp in each end section of the roll cover; and (c) a sealing rings arranged on each end wall adjacent to the clamping ring, said sealing ring being deformable radially against the outer ring by means of a second actuating device that acts separately from the actuation of the clamping ring in order to press an axial portion of the respective end section of the roll cover against the outer ring, wherein the first and second actuating devices are formed as first and second screws, each screw passing through a through opening to engage a threaded hole, the first screw engaging a threaded hole arranged in the clamping ring and the second screw engaging a threaded hole arranged in the end wall.

9. An extended-nip press roll according to claim 8, wherein the clamping ring has a conical outer circumferential surface which moves against an inner circumferential surface of the spreader ring, the inner circumferential surface forming a conical opposing surface.

10. An extended-nip press roll according to claim 9, wherein the clamping ring has a cylindrical inner circumferential surface and the spreader ring has a cylindrical outer circumferential surface.

* * * * *